US010438556B2

(12) United States Patent
Lee et al.

(10) Patent No.: US 10,438,556 B2
(45) **Date of Patent: *Oct. 8, 2019**

(54) DISPLAY APPARATUS AND METHOD OF DRIVING DISPLAY PANEL USING THE SAME

(71) Applicant: Samsung Display Co., Ltd., Yongin-Si, Gyeonggi-Do (KR)

(72) Inventors: Kyoung-Won Lee, Seoul (KR); Su-Hyeong Park, Gyeongju-si (KR); Mun-San Park, Hwaseong-si (KR); Joon-Chul Goh, Hwaseong-si (KR); Woo-Mi Bae, Daegu (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/789,264

(22) Filed: Oct. 20, 2017

(65) Prior Publication Data

US 2018/0040289 A1 Feb. 8, 2018

Related U.S. Application Data

(63) Continuation of application No. 14/690,711, filed on Apr. 20, 2015, now Pat. No. 9,818,364.

(30) Foreign Application Priority Data

Aug. 27, 2014 (KR) ..... 10-2014-0112366

(51) Int. Cl.
*G09G 3/36* (2006.01)

(52) U.S. Cl.
CPC ..... *G09G 3/3688* (2013.01); *G09G 3/3648* (2013.01); *G09G 3/3614* (2013.01);
(Continued)

(58) Field of Classification Search
CPC .. G09G 3/3688; G09G 3/3648; G09G 3/3614; G09G 3/3696; G09G 2310/0248;
(Continued)

(56) References Cited

U.S. PATENT DOCUMENTS 5,926,173 A 7/1999 Moon
8,094,147 B2 1/2012 Lee
(Continued)

FOREIGN PATENT DOCUMENTS

CN 101751865 A 6/2010
CN 102194426 A 9/2011
(Continued)

OTHER PUBLICATIONS

Chinese Office Action for Application No. 201510526126.7 dated Jun. 21, 2019 enumerating the above references within the Chinese Office Action.

*Primary Examiner* — Tom V Sheng
(74) *Attorney, Agent, or Firm* — Cantor Colburn LLP

(57) ABSTRACT

A display apparatus includes a timing controller, a data driver and a display panel. The timing controller receives input image data at a first frequency substantially equal to a frame rate of an input image. The timing controller generates a data signal having the first frequency based on the input image data having the first frequency. The data driver converts the data signal into a data voltage. The display panel displays an image based on the data voltage.

17 Claims, 8 Drawing Sheets

(52) U.S. Cl.
CPC ..... *G09G 3/3696* (2013.01); *G09G 2310/027* (2013.01); *G09G 2310/0248* (2013.01); *G09G 2310/0297* (2013.01); *G09G 2310/08* (2013.01); *G09G 2320/0276* (2013.01); *G09G 2330/021* (2013.01); *G09G 2340/0435* (2013.01); *G09G 2340/16* (2013.01)

(58) Field of Classification Search
CPC ..... G09G 2310/027; G09G 2310/0297; G09G 2310/08; G09G 2320/0276; G09G 2330/021; G09G 2330/022; G09G 2340/0435; G09G 2340/16
See application file for complete search history.

(56) References Cited

U.S. PATENT DOCUMENTS

| | | | | |
|---|---|---|---|---|
| 8,279,215 | B2 | 10/2012 | Nam et al. | |
| 8,373,685 | B2 | 2/2013 | Hsueh | |
| 8,674,969 | B2 * | 3/2014 | Ooga | G09G 3/20 345/173 |
| 8,797,256 | B2 | 8/2014 | Nam et al. | |
| 9,153,196 | B2 | 10/2015 | Hong et al. | |
| 9,818,364 | B2 * | 11/2017 | Lee | G09G 3/3648 |
| 2005/0068284 | A1 | 3/2005 | Joo | |
| 2006/0221001 | A1 | 10/2006 | Matono et al. | |
| 2008/0094320 | A1 | 4/2008 | Parikh et al. | |
| 2008/0100600 | A1 * | 5/2008 | Hsueh | G09G 3/3696 345/204 |
| 2009/0022229 | A1 * | 1/2009 | Sung | G09G 3/20 375/240.25 |
| 2010/0289966 | A1 | 11/2010 | Kobayashi | |
| 2011/0216058 | A1 | 9/2011 | Oh | |
| 2012/0032935 | A1 | 2/2012 | Yen | |
| 2012/0068994 | A1 | 3/2012 | Li et al. | |
| 2013/0033464 | A1 * | 2/2013 | Choi | G09G 3/3648 345/204 |
| 2014/0002739 | A1 * | 1/2014 | Kwa | H04N 5/46 348/536 |
| 2014/0168187 | A1 | 6/2014 | Qu et al. | |
| 2015/0206502 | A1 | 7/2015 | Kwang et al. | |
| 2015/0243204 | A1 | 8/2015 | Park et al. | |
| 2015/0255042 | A1 | 9/2015 | Oh et al. | |
| 2016/0035306 | A1 | 2/2016 | Park et al. | |

FOREIGN PATENT DOCUMENTS

| | | | |
|---|---|---|---|
| CN | 103871346 | A | 6/2014 |
| KR | 1020120137113 | A | 12/2012 |
| KR | 1020130131162 | A | 12/2013 |
| KR | 1020150134485 | A | 12/2015 |

* cited by examiner

DISPLAY APPARATUS AND METHOD OF DRIVING DISPLAY PANEL USING THE SAME

This application is a continuation of U.S. patent application Ser. No. 14/690,711, filed on Apr. 20, 2015, which claims priority to Korean Patent Application No. 10-2014-0112366, filed on Aug. 27, 2014, and all the benefits accruing therefrom under 35 U. S. C. § 119, the contents of which are herein incorporated by reference in their entireties.

BACKGROUND (1) Field

Exemplary embodiments of the present invention relate to a display apparatus and a method of driving a display panel using the display apparatus. More particularly, exemplary embodiments of the present invention relate to a display apparatus having reduced power consumption and a method of driving a display panel using the display apparatus.

(2) Description of the Related Art

A method to minimize the power consumption of an information technologies ("IT") product such as a desktop personal computer ("PC") and a laptop PC have been studied.

To minimize the power consumption of an IT product, which includes a display panel, the power consumption of the display panel may be minimized. When the display panel displays a static or still image, the display panel may be driven at a relatively low frequency, thus lowering the power consumption of the display panel.

Alternatively, when the display panel displays a video or moving image, the display panel is driven at a relatively high frequency. When the display panel is driven at high frequency, the power consumption is increased relative to being driven at a lower frequency.

SUMMARY

Exemplary embodiments of the present invention provide a display apparatus capable of reducing a power consumption of the display apparatus.

Exemplary embodiments of the present invention also provide a method of driving a display panel using the display apparatus.

In an exemplary embodiment of a display apparatus according to the present invention, the display apparatus includes a timing controller, a data driver and a display panel. The timing controller receives input image data at a first frequency, the first frequency being substantially equal to a frame rate of an input image. The timing controller generates a data signal having the first frequency based on the input image data having the first frequency. The data driver converts the data signal into a data voltage. The display panel displays an image based on the data voltage.

In an exemplary embodiment, the display apparatus may further include a decoder, a memory and a graphing processing unit. The decoder decodes the input image. The memory stores the decoded input image. The graphic processing unit converts the decoded input image into the input image data having the first frequency and outputs the input image data to the timing controller.

In an exemplary embodiment, the input image data may include active periods and blank periods which alternate with each other.

In an exemplary embodiment, gaps between the active periods may be substantially uniform.

In an exemplary embodiment, a length of the active period may be 1/60 second. A length of the blank period may be determined as the gap of the adjacent active periods.

In an exemplary embodiment, when the first frequency is 30 Hz (hertz), a length of the active period may be substantially equal to a length of the blank period.

In an exemplary embodiment, when the first frequency is less than 30 Hz (hertz), a length of the active period may be less than a length of the blank period.

In an exemplary embodiment, the timing controller may include a blank power control part which turns off the data driver during the blank period.

In an exemplary embodiment, the timing controller may further include a register. The register stores the frame rate of the input image. The blank power control part may output a blank control signal which varies according to the frame rate of the input image.

In an exemplary embodiment, the data driver may include a power control part, a digital to analog converting part, a buffering part, a first switching part and a second switching part. The power control part controls power according to a blank control signal determined according to the input image. The digital to analog converting part converts the data signal from a digital type data voltage to an analog type data voltage. The buffering part buffers the data voltage. The first switching part turns on during the active period and applies the data voltage to a data line. The second switching part turns on during the blank period and applies a blank voltage to the data line.

In an exemplary embodiment, the data driver may further include a power switching part. The power switching part turns off the digital to analog converting part and the buffering part during the blank period.

In an exemplary embodiment, the data driver may further include a blank voltage providing part. The blank voltage providing part provides the blank voltage to the second switching part.

In an exemplary embodiment, the second switching part may include switches in a first row and second row. The switches in the first row turn on alternately, and apply a first blank voltage to the data line. The switches in the second row turn on alternately, and apply a second blank voltage to the data line.

In an exemplary embodiment of a method of driving a display panel according to the present invention, the method includes receiving input image data at a first frequency, the first frequency being substantially equal to a frame rate of an input image, generating a data signal having the first frequency based on the input image data having the first frequency and displaying an image based on the data signal.

In an exemplary embodiment, the method may further include decoding the input image, storing the decoded input image in a memory, converting the decoded input image into the input image data having the first frequency and outputting the input image data to a timing controller.

In an exemplary embodiment, the input image data may include active periods and blank periods which alternate with each other.

In an exemplary embodiment, gaps between the active periods may be substantially uniform.

In an exemplary embodiment, the timing controller may control a data driver to turn off during the blank periods.

In an exemplary embodiment, the timing controller further comprises a register.

The register stores the frame rate of the input image.

According to the display apparatus and the method of driving the display panel using the display apparatus, when the display panel displays a video image, the display panel is driven at a frequency equal to a frame rate of the input image so that power consumption of the display panel may be reduced.

BRIEF DESCRIPTION OF THE DRAWINGS

The above and other aspects and advantages of this disclosure will become more apparent by describing in detailed exemplary embodiments thereof with reference to the accompanying drawings, in which.

DETAILED DESCRIPTION

Figure 1:
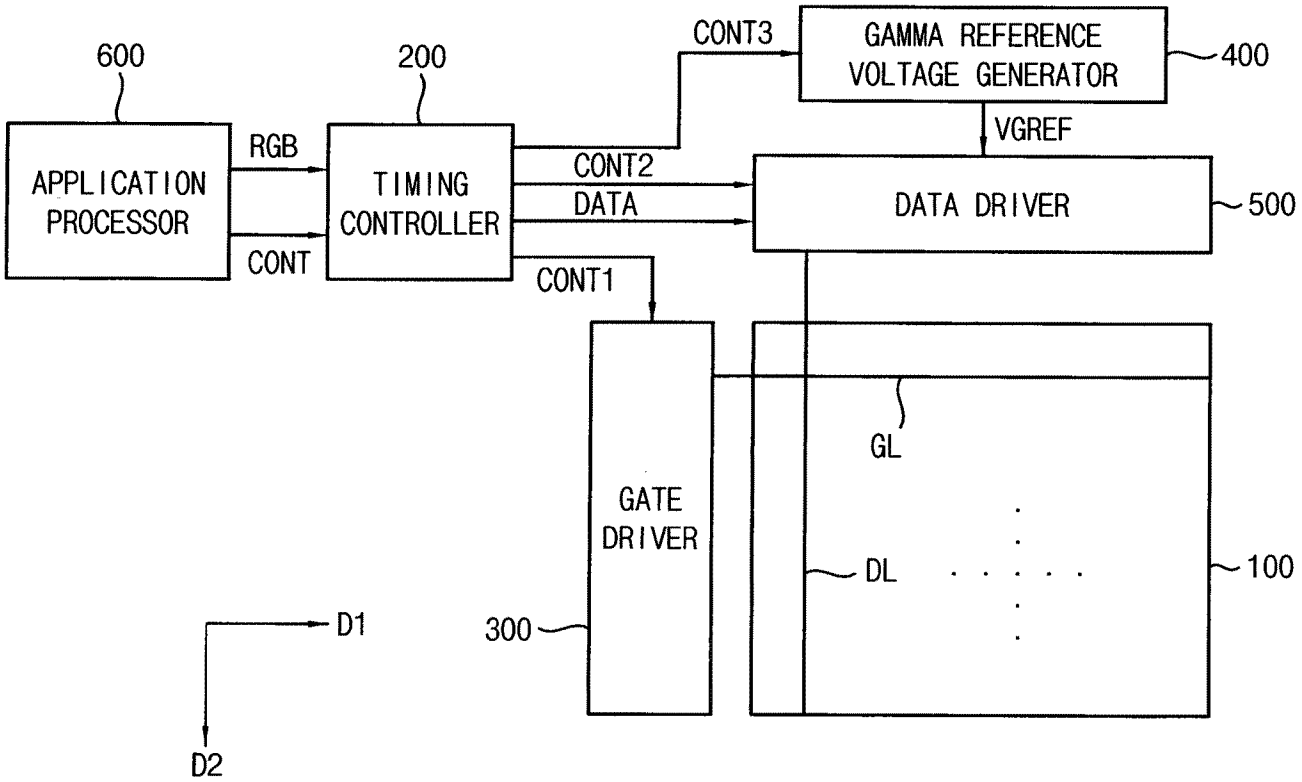
FIG. 1 is a block diagram of an exemplary embodiment illustrating a display apparatus according to an exemplary embodiment of the present invention.

Although the invention can be modified in various manners and have several embodiments, specific embodiments are illustrated in the accompanying drawings and will be mainly described in the specification. However, the scope of the exemplary embodiments of the invention is not limited to the specific embodiments and should be construed as including all the changes, equivalents, and substitutions included in the spirit and scope of the invention.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example In an exemplary embodiment, if when the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, the present invention according to an exemplary embodiment will be explained in further detail with reference to the accompanying drawings.

FIG. 1 is a block diagram illustrating an exemplary embodiment of a display apparatus according to the present invention.

Referring to FIG. 1, the display apparatus includes a display panel 100, a panel driver (200, 300, 400, 500) and an application processor 600. The panel driver includes a timing controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

Each pixel includes a switching element (not shown), a liquid crystal capacitor (not shown) and a storage capacitor (not shown). The liquid crystal capacitor and the storage capacitor are electrically connected to the switching element. The pixels may be disposed in a matrix form.

The timing controller 200 receives input image data RGB and an input control signal CONT from the application processor 600. In an exemplary embodiment, the input image data may include red image data ("R"), green image data ("G") and blue image data ("B"). In an exemplary embodiment, the input control signal CONT may include a master clock signal and a data enable signal. In an exemplary embodiment, the input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1, which controls an operation of the gate driver 300 based on the input control signal CONT, and outputs the first control signal CONT1 to the gate driver 300. In an exemplary embodiment, the first control signal CONT1 may further include a vertical start signal and a gate clock signal.

The timing controller 200 generates the second control signal CONT2, which controls an operation of the data driver 500 based on the input control signal CONT, and outputs the second control signal CONT2 to the data driver 500. In an exemplary embodiment, the second control signal CONT2 may include a horizontal start signal and a load signal.

The timing controller 200 generates the data signal DATA based on the input image data RGB. The timing controller 200 outputs the data signal DATA to the data driver 500.

In an exemplary embodiment, the timing controller 200 may control an operation of the gate driver 300 and an operation of the data driver 500 according to an active period of the input image data RGB and a blank period of the input image data RGB.

During the active period, the timing controller 200 controls the gate driver 300 and the data driver 500 to operate normally.

During the blank period, the timing controller 200 may not output the first control signal CONT1 to the gate driver 300. For example, during the blank period, the timing controller 200 may not output the vertical start signal to the gate driver 300.

In addition, during the blank period, the timing controller 200 may not output the second control signal CONT2 and the data signal DATA to the data driver 500. For example, during the blank period, the timing controller 200 may not output the horizontal start signal and the load signal to the data driver 500.

In an exemplary embodiment, the timing controller 200 may control a power to the data driver 500. For example, the timing control 200 may turn off the operation of the data driver 500 during the blank period of the input image data RGB. The timing controller 200 may output a blank control signal for controlling the power to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

An exemplary embodiment of a structure and an operation of the timing controller 200 are explained referring to FIG. 3 in further detail below.

The gate driver 300 generates gate signals driving the gate lines GL in response to the first control signal CONT1 received from the timing controller 200. The gate driver 300 sequentially outputs the gate signals to the gate lines GL.

In an exemplary embodiment, the gate driver 300 may be directly mounted on the display panel 100, or may be connected to the display panel 100 as a tape carrier package ("TCP") type. Alternatively, in another exemplary embodiment the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the data driver 500. Alternatively, in another exemplary embodiment the gamma reference voltage generator 400 may be disposed in the timing controller 200.

The data driver 500 receives the second control signal CONT2 and the data signal DATA from the timing controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

The data driver 500 outputs the data voltages to the data lines DL during the active period of the input image data RGB. The data driver 500 outputs a blank voltage to the data lines DL during the blank period of the input image data RGB.

In an exemplary embodiment, the data driver 500 may be directly mounted on the display panel 100, or alternatively be connected to the display panel 100 in a TCP type. Alternatively, in another exemplary embodiment the data driver 500 may be integrated on the display panel 100.

An exemplary embodiment of a structure and an operation of the data driver 500 are explained referring to FIGS. 5, 6A and 6B in further detail below.

The application processor 600 decodes an input image and converts the decoded input image into the input image data RGB. The application processor 600 outputs the input image data RGB to the timing controller 200.

The application processor 600 outputs the input control signal CONT to the timing controller 200.

An exemplary embodiment of a structure and an operation of the application processor 600 are explained referring to FIG. 2 in further detail below.

Figure 2:
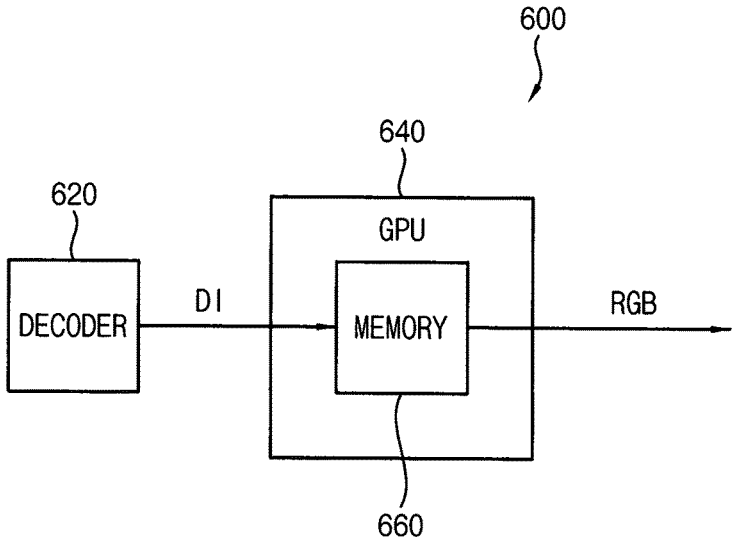
FIG. 2 is a block diagram of an exemplary embodiment illustrating an application processor of FIG. 1.

FIG. 2 is a block diagram illustrating an exemplary embodiment of the application processor 600 of FIG. 1. FIG. 3 is a block diagram illustrating an exemplary embodiment of the timing controller 200 of FIG. 1. FIG. 4 is a conceptual diagram illustrating an exemplary embodiment of signals of the timing controller 200 and the data driver 500 of FIG. 1.

Referring to FIGS. 1, 2 and 4, the application processor 600 includes a decoder 620 and a graphic processing unit 640 and a memory 660.

The decoder 620 decodes the input image. The input image has a frame rate. The frame rate means a refresh rate of the video image. That is, frame rate, also known as frame frequency and frames per second ("fps"), is the frequency (rate) at which an imaging device produces unique consecutive images called frames. The frame rate is defined as the number of the frames during a preset period of time. For example, the frame rate of the input image may be 30 fps (frame per second). For example, the frame rate of the input image may be 24 fps.

The decoder 620 sends the decoded input image DI to the memory 660. The decoded input image DI is stored in the memory 660.

The graphic processing unit 640 converts the decoded input image DI, which is stored in the memory 660, into the input image data RGB having a first frequency.

The graphic processing unit 640 controls writing the decoded input image DI to the memory 660 and reading the decoded input image DI from the memory 660 at the first frequency.

Referring to FIG. 4, the input image data RGB includes active periods A1, A2, A3 and A4 and blank periods B1, B2, B3 and B4 which alternate with each other. In an exemplary embodiment, the gaps between the active periods A1, A2, A3 and A4 may be substantially uniform. The length of the blank period may be defined as the gap between adjacent active periods.

The length of an active period may be determined based on a normal driving frequency of the display panel 100. For example, in an exemplary embodiment when the normal driving frequency of the display panel 100 is 60 Hz (hertz), the length of the active period may be determined to 1/60 second which is 1/(normal driving frequency). Alternatively, in an exemplary embodiment, the length of the active period may be slightly shorter than 1/(normal driving frequency).

Figure 3:
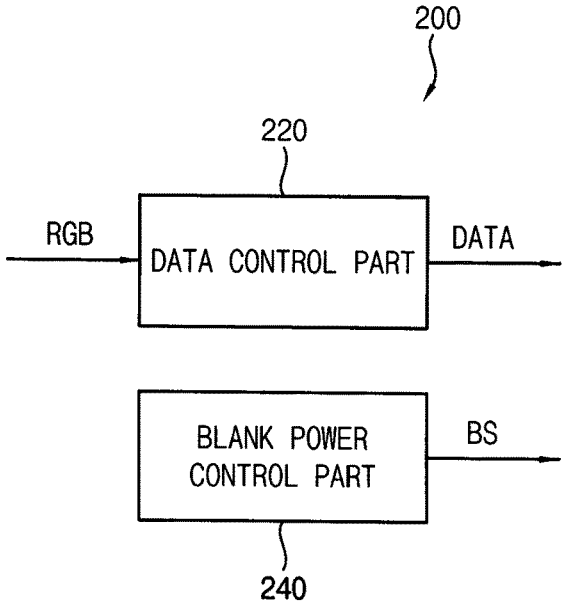
FIG. 3 is a block diagram of an exemplary embodiment illustrating a timing controller of FIG. 1.
Figure 4:
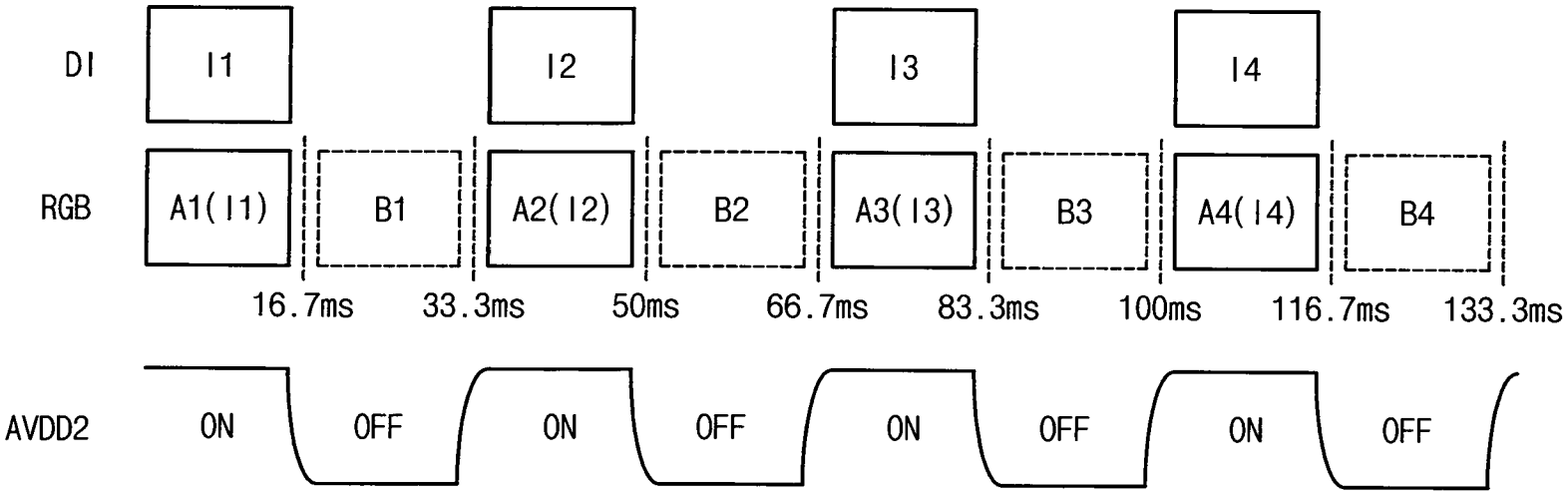
FIG. 4 is a conceptual diagram of an exemplary embodiment illustrating signals of the timing controller and a data driver of FIG. 1.

Referring to FIG. 3, the timing controller 200 includes a data control part 220 and a blank power control part 240.

The data control part 220 receives the input image data RGB at the first frequency and generates the data signal DATA having the first frequency. The data control part 220 outputs the data signal having the first frequency to the data driver 500.

The data control part 220 compensates grayscale data of the input image data RGB and rearranges the input image data RGB to generate the data signal DATA to correspond to a data type of the data driver 500. In an exemplary embodiment, the data signal DATA may be digital type signal.

For example, in an alternative exemplary embodiment the data control part 220 may include an adaptive color correcting part (not shown) and a dynamic capacitance compensating part (not shown).

The adaptive color correcting part receives the grayscale data of the input image data RGB, and operates an adaptive color correction ("ACC"). The adaptive color correcting part may compensate the grayscale data using a gamma curve.

The dynamic capacitance compensating part operates a dynamic capacitance compensation ("DCC"), which compensates the grayscale data of the present frame data using the previous frame data and the present frame data.

The blank power control part 240 controls the data driver 500 to turn off corresponding to a blank period of the input image data RGB. The blank power control part 240 outputs a blank control signal BS to control when the data driver 500 turns on and off.

Although not shown in figures, in another exemplary embodiment, the timing controller 200 may further include a low frequency driving part.

The low frequency driving part (not shown) receives the input image data RGB. The low frequency driving part determines a driving frequency of the display panel 100 based on the input image data RGB. For example, when the input image data RGB is a static or still image, the low frequency driving part drives the display panel 100 at a relatively low frequency. For example, in an exemplary embodiment the relatively low frequency may be about 1 Hz. For example, when the input image data RGB is a video or moving image, the low frequency driving part drives the display panel 100 at a relatively high frequency. For example, in an exemplary embodiment the relatively high frequency may be the first frequency.

In FIG. 4, for example, the frame rate of the input image is 30 fps. When the frame rate of the input image is 30 fps, the input image includes thirty frame images per second.

The input image DI decoded by the decoder 620 is stored in the memory 660.

The input image data RGB has the first frequency which is substantially equal to the frame rate (30 fps) of the input image. When the frame rate of the input image is 30 fps, the first frequency of the input image data RGB may be 30 Hz.

The input image data RGB includes thirty frame images per second and thirty active periods per second. In addition, the input image data RGB includes thirty blank periods per second.

The length of an active period of the input image data RGB may be determined based on the normal driving frequency of the display panel 100. For example, in an exemplary embodiment when the normal driving frequency of the display panel 100 is 60 Hz, the length of an active period may be determined to 1/60 second. Alternatively, in another exemplary embodiment when the normal driving frequency of the display panel 100 is 60 Hz, the length of an active period may be slightly shorter than 1/60 second.

For example, when the first frequency is 30 Hz, the length of an active period may be substantially the same as the length of a blank period.

In FIG. 4, the input image data RGB includes a first active period A1 during which a first input image I1 is displayed and a first blank period B1 subsequent to the first active period A1. The length of the first active period A1 is about 16.67 ms. The length of the first blank period B1 is about 16.67 ms.

The input image data RGB includes a second active period A2 subsequent to the first blank period B1 and a second blank period B2 subsequent to the second active period A2. During the second active period A2, a second input image 12 is displayed. The length of the second active period A2 is about 16.67 ms. The length of the second blank period B2 is about 16.67 ms.

The input image data RGB includes a third active period A3 subsequent to the second blank period B2 and a third blank period B3 subsequent to the third active period A3. During the third active period A3, a third input image 13 is displayed. The length of the third active period A3 is about 16.67 ms. The length of the third blank period B3 is about 16.67 ms.

The blank power control part 240 controls the data driver 500 to turn off during a blank period. For example, in an exemplary embodiment a power voltage AVDD2 transmitted to the data driver 500 may have an ON-level during an active period and an OFF-level during a blank period.

Figure 5:
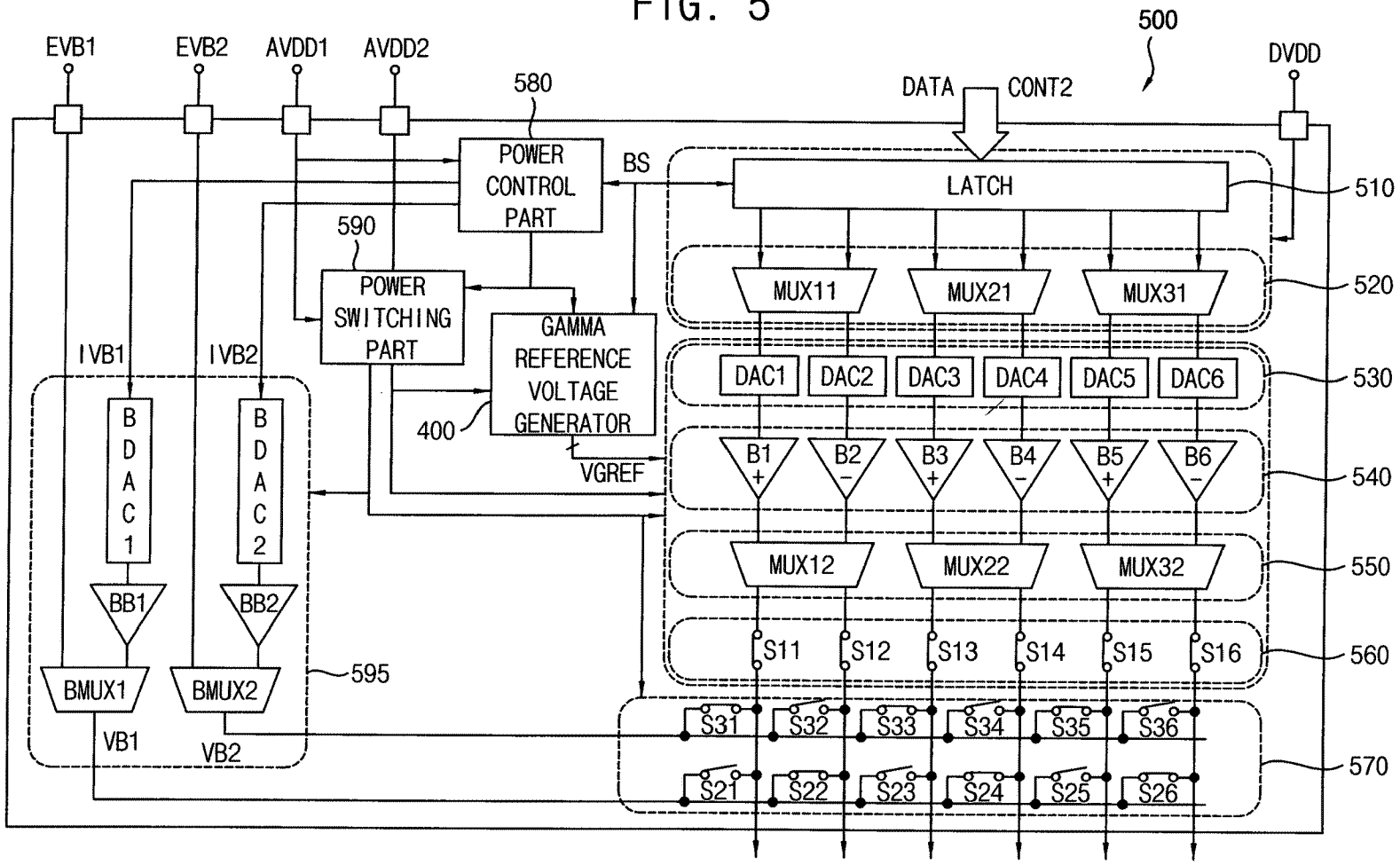
FIG. 5 is a block diagram of an exemplary embodiment illustrating the data driver of FIG. 1.

FIG. 5 is a block diagram illustrating an exemplary embodiment of the data driver 500 of FIG. 1. FIG. 6A is a block diagram illustrating an exemplary embodiment of the data driver 500 of FIG. 1 in an active period. FIG. 6B is a block diagram illustrating an exemplary embodiment of the data driver 500 of FIG. 1 in a blank period.

Referring to FIGS. 1 to 6B, the data driver 500 includes a latch part 510, a first multiplexing part 520, a digital to analog converting part 530, a buffering part 540, a second multiplexing part 550, a first switching part 560, a second switching part 570, a power control part 580, a power switching part 590 and a blank voltage providing part 595.

The latch part 510 receives the data signal DATA and the second control signal CONT2. The latch part 510 temporally stores the data signal DATA and outputs the data signal DATA to the digital to analog converting part 530 through the first multiplexing part 520. In an exemplary embodiment, a digital power voltage DVDD may be applied to the latch part 510 and the first multiplexing part 520.

The digital to analog converting part 530 generates the analog data voltage based on the digital data signal DATA and the gamma reference voltage VGREF. The digital to analog converting part 530 outputs the data voltage to the buffering part 540.

The digital to analog converting part 530 may include a plurality of digital to analog converters DAC1 to DAC6. Although six analog digital to analog converters are shown in FIGS. 5, 6A and 6B for convenience of explanation, the present invention is not limited to any number of digital to analog converters. For example, the digital to analog converting part 530 may include as many digital to analog converters as needed in order to correspond to the number of the data lines DL.

The buffering part 540 buffers the data voltage. The buffering part 540 compensates the data voltage to have a uniform level. The buffering part 540 outputs the compensated data voltage to the data line DL through the second multiplexing part 550, the first switching part 560 and the second switching part 570.

The buffering part 540 in an exemplary embodiment may include a plurality of buffers B1 to B6. For example, first, third and fifth buffers B1, B3 and B5 may buffer data voltage having a first polarity. Second, fourth and sixth buffers B2, B4 and B6 may buffer data voltage having a second polarity which is opposite to the first polarity.

The first multiplexing part 520 and the second multiplexing part 550 operate as a path selector. For example, when data voltages having the first polarity are outputted to odd-numbered data lines and data voltages having the second polarity are outputted to even-numbered data lines during a first frame, a first multiplexer MUX11 of the first multiplexing part 520 and a second multiplexer MUX12 of the second multiplexing part 550 transmit a first data voltage of the first polarity to the first data line through the first digital to analog converter DAC1 and the first buffer B1, and transmit a second data voltage of the second polarity to the second data line through the second digital to analog converter DAC2 and the second buffer B2, respectively.

In contrast, when data voltages having the second polarity are outputted to odd-numbered data lines and data voltages having the first polarity are outputted to even-numbered data lines during a second frame, the first multiplexer MUX11 of the first multiplexing part 520, and the second multiplexer MUX12 of the second multiplexing part 550, transmit a second data voltage of the first polarity to the second data line through the first digital to analog converter DAC1 and the first buffer B1, and transmit a first data voltage of the second polarity to the first data line through the second digital to analog converter DAC2 and the second buffer B2, respectively.

During an active period of the input image data RGB, the first switching part 560 is turned on to apply the data voltage to the data line DL. In contrast, during a blank period of the input image data RGB, the first switching part 560 is turned off to disconnect the buffering part 540 from the data line DL.

The first switching part 560 includes a plurality of switches S11 to S16. When the switches S11 to S16 of the first switching part 560 are turned on, the buffering part 540 is connected to the data line DL. When the switches S11 to S16 of the first switching part 560 are turned off, the buffering part 540 is disconnected from the data line DL.

Although not shown in figures, in an exemplary embodiment the second multiplexing part 550 may be integrally formed with the first switching part 560 so that the multiplexing operation of the second multiplexing part 550 and the switching operation of the first switching part 560 may be simultaneously operated.

During a blank period of the input image data RGB, the second switching part 570 is turned on to apply a blank voltage to the data line DL. In contrast, during an active period of the input image data RGB, the second switching part 570 is turned off not to apply the blank voltage to the data line DL.

The second switching part 570 includes a plurality of switches S21 to S26 in a first row and a plurality of switches S31 to S36 in a second row. In an exemplary embodiment, during a blank period of the input image data RGB, the switches S21 to S26 in the first row may be alternately turned on, while the others in the first row are alternately turned off. In an exemplary embodiment, during a blank period of the input image data RGB, the switches S31 to S36 in the second row may be alternately turned on (i.e., S32, S34, S36). In addition, during a blank period of the input image data RGB, the switch S21 and the switch S31, which are connected to the first data line, may be alternately turned on (i.e., S21, S23, S25). For example, during a blank period of the input image data RGB, switch S21 may be turned on and switch S31 may be turned off.

During the first blank period B1 of the input image data RGB, the switches S21 to S26 in the first row may apply a first blank voltage VB1 to the odd-numbered data lines and the switches S31 to S36 in the second row may apply a second blank voltage VB2 to the even-numbered data lines. For example, in an exemplary embodiment during the first blank period B1 of the input image data RGB, the first, third and fifth switches S21, S23 and S25 in the first row may be turned on to apply the first blank voltage VB1 to the odd-numbered data lines and the second, fourth and sixth switches S32, S34 and S36 in the second row may be turned on to apply the second blank voltage VB2 to the even-numbered data lines.

In an exemplary embodiment, the first blank voltage VB1 may have a polarity opposite to a polarity of the second blank voltage VB2. For example, the first blank voltage VB1 may have a positive polarity and the second blank voltage VB2 may have a negative polarity.

During the second blank period B2 of the input image data RGB, when polarities of the data voltages are inverted with respect to polarities of the data voltages in the first blank period B1, the switches S21 to S26 in the first row may apply the first blank voltage VB1 to the even-numbered data lines and the switches S31 to S36 in the second row may apply the second blank voltage VB2 to the odd-numbered data lines. For example, in an exemplary embodiment during the second blank period B2 of the input image data RGB, the second, fourth and sixth switches S22, S24 and S26 in the first row may be turned on to apply the first blank voltage VB1 to the even-numbered data lines and the first, third and fifth switches S31, S33 and S35 in the second row may be turned on to apply the second blank voltage VB2 to the odd-numbered data lines.

In an exemplary embodiment, the power control part 580 controls power of the data driver 500 according to the blank control signal BS. During an active period of the input image data RGB, the power control part 580 may turn on the first switching part 560 and may turn off the second switching part 570. During a blank period of the input image data RGB, the power control part 580 may turn off the first switching part 560 and may turn on the second switching part 570.

In an exemplary embodiment, the power control part 580 may control an operation of the power switching part according to the blank control signal BS. In addition, the power control part 580 may control an operation of the gamma reference voltage generator 400 according to the blank control signal BS.

The power switching part 590 turns on or turns off elements in the data driver 500 according to control of the power control part 580.

In an alternative exemplary embodiment during a blank period of the input image data RGB, the power switching part 590 may turn off the digital to analog converting part 530 and the buffering part 540. During a blank period of the input image data RGB, the power switching part 590 may turn off the gamma reference voltage generator 400, the first multiplexing part 520 and the second multiplexing part 550.

During an active period of the input image data RGB, the power switching part 590 may turn off the blank voltage providing part 595.

In the present exemplary embodiment, a first analog power voltage AVDD1 and a second analog power voltage AVDD2 are applied to the power switching part 590. The first analog power voltage AVDD1 may be a constant voltage. In contrast, the second analog power voltage AVDD2 may be variable. For example, in an exemplary embodiment, the second analog power voltage AVDD2 may have a high level (ON-level) during an active period of the input image data RGB. In contrast, the second analog power voltage AVDD2 may have a low level (OFF-level) during a blank period of the input image data RGB. In the present exemplary embodiment, the blank power control operation is performed by the data driver 500, and thus the variable second analog power voltage AVDD2 is provided to the data driver 500 from outside. Accordingly, elements which are required to be always turned on are driven by the first analog power voltage AVDD1.

Alternatively, in an exemplary embodiment, only one power voltage having a constant voltage is applied to the power switching part 590 and the blank power control operation may be performed in the data driver 500.

The blank voltage providing part 595 provides the blank voltages VB1 and VB2 to the second switching part 570. During a blank period of the input image data RGB, the blank voltages VB1 and VB2 are applied to the data line DL through the second switching part 570.

In the present exemplary embodiment, the blank voltage VB1 and VB2 may be determined by one of the external blank voltages EVB1 and EVB2 applied from outside of the data driver 500 and one of the internal blank voltages IVB1 and IVB2 generated in the power control part 580.

The blank voltages VB1 and VB2 may be determined using an average pixel voltage of pixels of the display panel 100 corresponding to the input image. For example, in an exemplary embodiment the external blank voltages EVB1 and EVB2 may not vary in real time. The external blank voltages EVB1 and EVB2 may be predetermined by an average pixel voltage of the pixels of the display panel 100 corresponding to a normal image. For example, in an exemplary embodiment the internal blank voltages IVB1 and IVB2 may vary in real time. The internal blank voltages IVB1 and IVB2 may be determined by an average pixel voltage of the pixels of the display panel 100 corresponding to the input image in each frame.

For example, the first blank voltage VB1 may have a first polarity. The second blank voltage VB2 may have a second polarity opposite to the first polarity. Correspondingly, a first external blank voltage EVB1 may have the first polarity and a second external blank voltage EVB2 may have the second polarity. Correspondingly, a first internal blank voltage IVB1 may have the first polarity and a second internal blank voltage IVB2 may have the second polarity.

The blank voltage providing part 595 includes blank digital to analog converting parts BDAC1 and BDAC2, blank buffering parts BB1 and BB2 and blank multiplexing parts BMUX1 and BMUX2.

The blank digital to analog converting parts BDAC1 and BDAC2 include a first blank digital to analog convertor BDAC1 and a second blank digital to analog convertor BDAC2. The first blank digital to analog convertor BDAC1 converts the first internal blank voltage IVB1 having a digital type signal, which is received from the power control part 580, into an analog type signal. The second blank digital to analog convertor BDAC2 converts the second internal blank voltage IVB2, which is received from the power control part 580, from a digital voltage to an analog voltage.

The blank buffering part BB1 and BB2 includes a first blank buffer BB1 and a second blank buffer BB2. The first blank buffer BB1 is connected to the first blank digital to analog converter BDAC1 to buffer the first internal blank voltage IVB1, which is converted into an analog voltage. The second blank buffer BB2 is connected to the second blank digital to analog converter BDAC2 to buffer the second internal blank voltage IVB2, which is converted into an analog voltage.

The blank multiplexing parts BMUX1 and BMUX2 include a first blank multiplexer BMUX1 and a second blank multiplexer BMUX2, respectively. The first blank multiplexer BMUX1 is connected to a first external line, which applies the first external blank voltage EVB1 and the first blank buffer BB1 to selectively output one of the first external blank voltage EVB1 and the first internal blank voltage IVB1. The second blank multiplexer BMUX2 is connected to a second external line, which applies the second external blank voltage EVB2 and the second blank buffer BB2 to selectively output one of the second external blank voltage EVB2 and the second internal blank voltage IVB2.

Unlike the above explanation, in an alternative exemplary embodiment, the blank voltages VB1 and VB2 may be only determined by the internal blank voltages IVB1 and IVB2, which are generated in the power control part 580. The blank voltages VB1 and VB2 may vary in real time based on the input image data RGB. In the present exemplary embodiment, the blank voltage providing part 595 may not include the blank multiplexing parts BMUX1 and BMUX2.

Unlike the above explanation, in an alternative exemplary embodiment, the blank voltages VB1 and VB2 may be only determined by the external blank voltages EVB1 and EVB2, which are provided from outside of the data driver 500. The blank voltages VB1 and VB2 may not vary in real time. In the present exemplary embodiment, the data driver 500 may not include the blank voltage providing part 595.

Figure 6A:
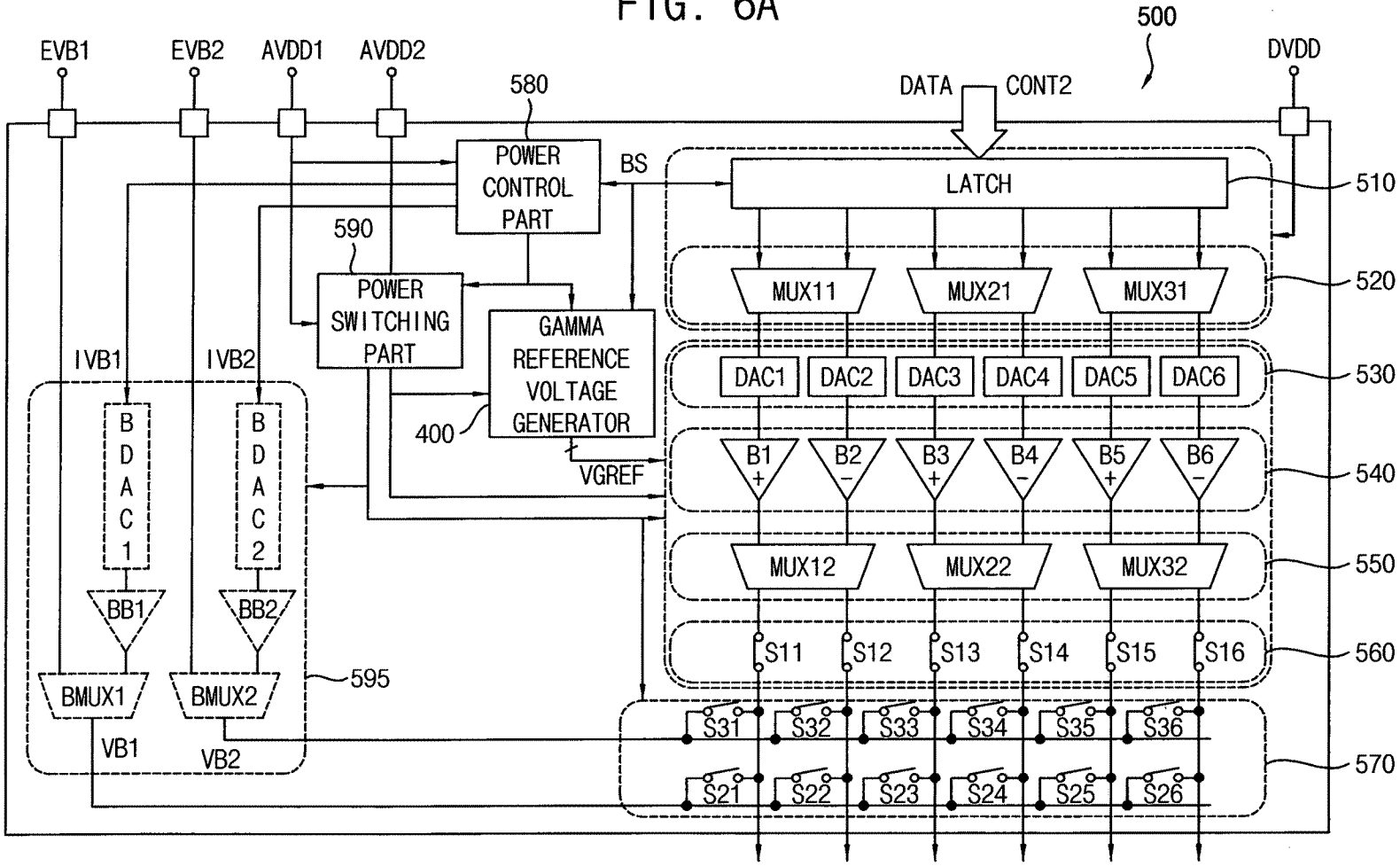
FIG. 6A is a block diagram of an exemplary embodiment illustrating the data driver of FIG. 1 in an active period.

FIG. 6A represents an exemplary embodiment of an operation of the data driver 500 during an active period of the input image data RGB. Referring again to FIG. 6A, during an active period of the input image data RGB, the latch part 510, the digital to analog converting part 530 and the buffering part 540 are turned on so that a normal data voltage which is applied to the data line DL is generated. In addition, during an active period of the input image data RGB, the first switching part 560 is turned on to apply the normal data voltage to the data line DL.

In contrast, during an active period of the input image data RGB, the blank voltage providing part 595 is turned off so that the blank voltages VB1 and VB2 are not generated. In addition, during an active period of the input image data RGB, all switches S21 to S26 and S31 to S36 of the second switching part 570 are turned off so that the data lines DL are not connected to blank voltage applying lines.

Figure 6B:
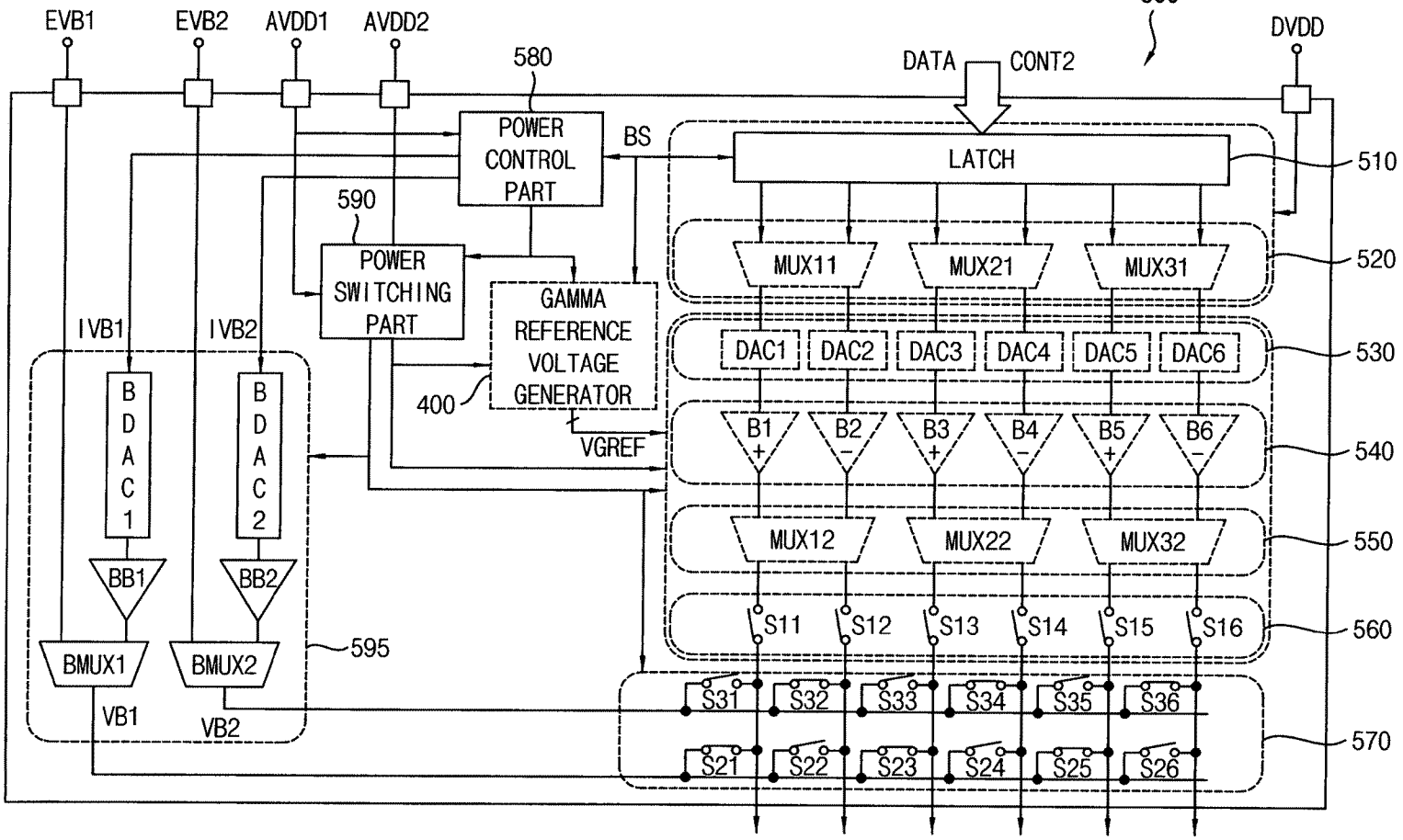
FIG. 6B is a block diagram of an exemplary embodiment illustrating the data driver of FIG. 1 in a blank period.

FIG. 6B represents an exemplary embodiment of an operation of the data driver 500 during a blank period of the input image data RGB. Referring again to FIG. 6B, during a blank period of the input image data RGB, the latch part 510, the digital to analog converting part 530 and the buffering part 540 are turned off so that the normal data voltage which is applied to the data line DL is not generated. In addition, during a blank period of the input image data RGB, the first switching part 560 is turned off so that the data lines DL are not connected to the buffering part 540.

In contrast, during a blank period of the input image data RGB, the blank voltage providing part 595 is turned on so that the blank voltages VB1 and VB2 are provided to the second switching part 570. In addition, during a blank period of the input image data RGB, the second switching part 570 is turned on to apply the blank voltages VB1 and VB2 to the data lines DL.

According to the present exemplary embodiment, when the display apparatus displays a video image, the input image data RGB has a frequency (e.g., 30 Hz) equal to the frame rate (e.g., 30 fps) of the input image. Thus, the power consumption to convert the input image having the frame rate (e.g., 30 fps) into the input image data RGB having the frequency (e.g., 60 Hz and 120 Hz) higher than the frame rate (e.g., 30 fps) may be reduced. In addition, the power consumption to display the image at the frequency (e.g., 60 Hz and 120 Hz) greater than the frame rate (30 fps) of the input image may be reduced. In particular, during the blank period of the input image data RGB, the power consumption of the data driver 500 may be dramatically reduced by the blank power control method. Therefore, when the display apparatus displays a video image, the power consumption of the display apparatus may be dramatically reduced.

Figure 7:
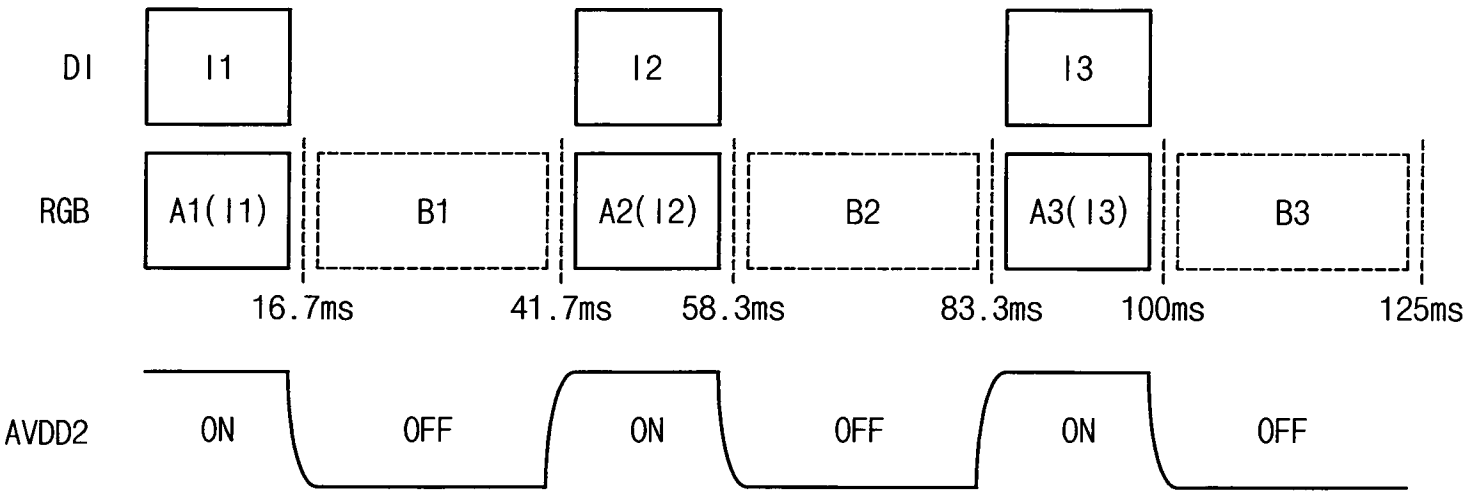
FIG. 7 is a conceptual diagram of an exemplary embodiment illustrating signals of a timing controller and a data driver according to the present invention.

FIG. 7 is a conceptual diagram of an exemplary embodiment illustrating the signals of a timing controller 200 and a data driver 500 according to the present invention.

The display apparatus according to the present exemplary embodiment are substantially the same as the display apparatus of the previous exemplary embodiment explained referring to FIGS. 1 to 6B except that the frame rate of the input image is 24 fps instead of 30 fps. Thus, the same reference numerals will be used to refer to the same or like parts as those described in the previous exemplary embodiment of FIGS. 1 to 6B and any repetitive explanation concerning the above elements will be omitted.

Referring to FIGS. 1 to 3, 5, 6A, 6B and 7, the display apparatus includes a display panel 100, a panel driver and an application processor 600. The panel driver includes a timing controller 200, a gate driver 300, a gamma reference voltage generator 400 and a data driver 500.

The application processor 600 includes a decoder 620 and a graphic processing unit 640 and a memory 660.

The decoder 620 decodes the input image. The input image has a frame rate.

The decoder 620 sends the decoded input image DI to the memory 660. The input image DI is stored in the memory 660.

The graphic processing unit 640 converts the decoded input image DI which is stored in the memory 660 into the input image data RGB having a first frequency.

The input image data RGB includes active periods A1, A2, A3 and A4 and blank periods B1, B2, B3 and B4 which alternate with each other (i.e., A1, B1, A2, B2, A3, B3, A4, B4). The gaps between the active periods A1, A2, A3 and A4 may be substantially uniform. A length of the blank period may be defined as the gap of the adjacent active periods A1, A2, A3 and A4.

In FIG. 7, for example, the frame rate of the input image is 24 fps. When the frame rate of the input image is 24 fps, the input image includes twenty four frame images per second.

The input image DI decoded by the decoder 620 is stored in the memory 660.

The input image data RGB has the first frequency which is substantially equal to the frame rate (24 fps) of the input image. When the frame rate of the input image is 24 fps, the first frequency of the input image data RGB may be 24 Hz.

The input image data RGB includes twenty four frame images per second and twenty four active periods per second. In addition, the input image data RGB includes twenty four blank periods per second.

The length of an active period may be determined based on the normal driving frequency of the display panel 100. For example, in an exemplary embodiment when the normal driving frequency of the display panel 100 is 60 Hz, the length of an active period may be determined to 1/60 second. Alternatively, when the normal driving frequency of the display panel 100 is 60 Hz, the length of an active period may be slightly shorter than 1/60 second.

For example, when the first frequency is less than 30 Hz, the length of an active period may be shorter than the length of a blank period. For example, when the first frequency is 24 Hz, the length of an active period may be shorter than the length of a blank period.

In FIG. 7, the input image data RGB includes the first active period A1 during which a first input image I1 is displayed and the first blank period B1 subsequent to the first active period A1. The length of the first active period A1 is about 16.67 ms. The length of the first blank period B1 is about 25 ms.

The input image data RGB includes the second active period A2 subsequent to the first blank period B1 and the second blank period B2 subsequent to the second active period A2. During the second active period A2, a second input image 12 is displayed. The length of the second active period A2 is about 16.67 ms. The length of the second blank period B2 is about 25 ms.

The input image data RGB includes the third active period A3 subsequent to the second blank period B2 and the third blank period B3 subsequent to the third active period A3. During the third active period A3, a third input image 13 is displayed. The length of the third active period A3 is about 16.67 ms. The length of the third blank period B3 is about 25 ms.

The blank power control part 240 of the timing controller 200 controls the data driver 500 to be turned off during the blank periods of the input image data RGB. For example, a power voltage AVDD2 transmitted to the data driver 500 may have an ON-level during the active periods of the input image data RGB and an OFF-level during the blank periods of the input image data RGB.

According to the present exemplary embodiment, when the display apparatus displays a video image, the input image data RGB has the frequency (e.g., 24 Hz) equal to the frame rate (e.g., 24 fps) of the input image. Thus, the power consumption to convert the input image having the frame rate (e.g., 24 fps) into the input image data RGB having the frequency (e.g., 60 Hz and 120 Hz) higher than the frame rate (e.g., 24 fps) may be reduced. In addition, the power consumption to display the image at the frequency (e.g., 60 Hz and 120 Hz) greater than the frame rate (24 fps) of the input image may be reduced. In particular, during the blank periods, the power consumption of the data driver 500 may be dramatically reduced by the blank power control method. Therefore, when the display apparatus displays a video image, the power consumption of the display apparatus may be dramatically reduced.

Figure 8:
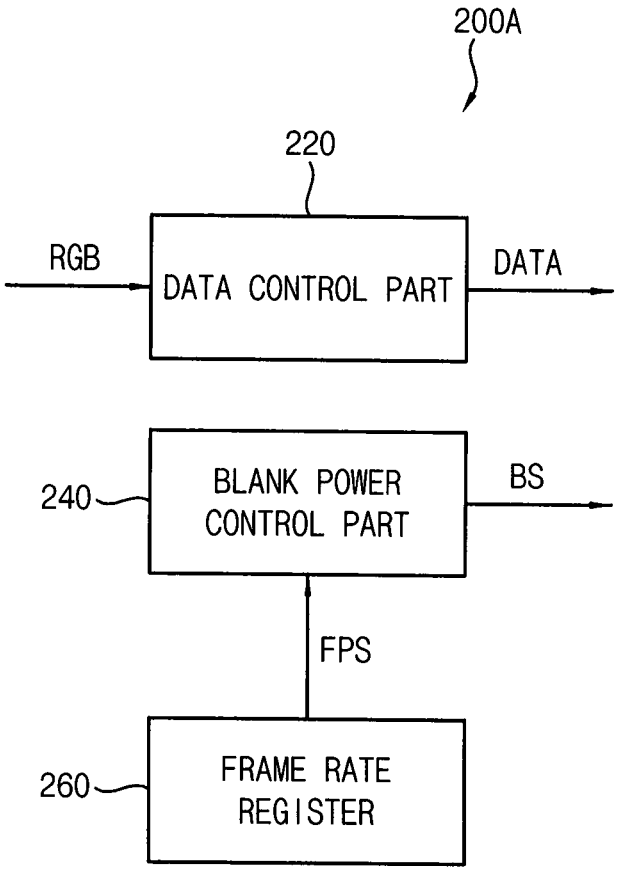
FIG. 8 is a block diagram of an exemplary embodiment illustrating a timing controller according to the present invention.

FIG. 8 is a block diagram illustrating an exemplary embodiment of a timing controller 200A according to the present invention.

The display apparatus according to the present exemplary embodiment are substantially the same as the display apparatus of the previous exemplary embodiment explained referring to FIGS. 1 to 6B except for the structure of the timing controller 200. Thus, the same reference numerals will be used to refer to the same or like parts as those described in the previous exemplary embodiment of FIGS. 1 to 6B and any repetitive explanation concerning the above elements will be omitted.

Referring to FIGS. 1, 2, 4 to 6B and 8, the display apparatus includes a display panel 100, a panel driver and an application processor 600. The panel driver includes a timing controller 200, a gate driver 300, a gamma reference voltage generator 400 and a data driver 500.

The application processor 600 includes a decoder 620, a graphic processing unit 640 and a memory 660.

The decoder 620 decodes the input image DI. The input image DI has a frame rate. The decoder 620 sends the decoded input image DI to the memory 660. The input image DI is stored in the memory 660.

The graphic processing unit 640 converts the decoded input image DI, which is stored in the memory 660, into the input image data RGB having a first frequency.

The input image data RGB includes active periods A1, A2, A3 and A4 and blank periods B1, B2, B3 and B4, which alternate with each other (i.e., A1, B1, A2, B2, A3, B3, A4, B4). The gaps between the active periods A1, A2, A3 and A4 may be substantially uniform. A length of the blank period may be defined as the gap of the adjacent active periods A1, A2, A3 and A4.

The timing controller 200A includes a data control part 220 and a blank power control part 240. In an exemplary embodiment, the timing controller 200A may further include a frame rate register 260.

The data control part 220 receives the input image data RGB at the first frequency and generates the data signal DATA having the first frequency. The data control part 220 outputs the data signal having the first frequency to the data driver 500.

The data control part 220 compensates grayscale data of the input image data RGB and rearranges the input image data RGB to generate the data signal DATA to correspond to a data type of the data driver 500. In an exemplary embodiment, the data signal DATA may be a digital type signal.

For example, the data control part 220 may include an adaptive color correcting part (not shown) and a dynamic capacitance compensating part (not shown).

The blank power control part 240 controls the data driver 500 to turn off corresponding to a blank period of the input image data RGB. The blank power control part 240 outputs a blank control signal BS to control when the data driver 500 turns on and off.

The frame rate register 260 stores the frame rate FPS of the input image. The graphic processing unit 640 may output the frame rate FPS of the input image to the frame rate register 260.

The blank power control part 240 may output the blank control signal BS, which varies according to the frame rate FPS of the input image. For example, in an exemplary embodiment when the frame rate FPS of the input image is 24 fps, the power voltage AVDD2 may maintain an OFF-level for a blank period of the input image data RGB which is about 25 ms. For example, when the frame rate FPS of the input image is 30 fps, the power voltage AVDD2 may maintain an OFF-level for a blank period of the input image data RGB which is about 16.67 ms.

According to the present exemplary embodiment, when the display apparatus displays a video image, the input image data RGB has the frequency (e.g., 30 Hz, 24 Hz) equal to the frame rate (e.g., 30 fps, 24 fps) of the input image. Thus, the power consumption to convert the input image DI having the frame rate (e.g., 30 fps, 24 fps) into the input image data RGB having the frequency (e.g., 60 Hz and 120 Hz) higher than the frame rate (e.g., 30 fps, 24 fps) may be reduced. In addition, the power consumption to display the image at the frequency (e.g., 60 Hz and 120 Hz) greater than the frame rate (30 fps, 24 fps) of the input image DI may be reduced. In particular, during a blank period of the input image data RGB, the power consumption of the data driver 500 may be dramatically reduced by the blank power control method. Therefore, when the display apparatus displays a video image, the power consumption of the display apparatus may be dramatically reduced.

According to the present exemplary embodiment, the power consumption of the display apparatus may be dramatically reduced when the display apparatus displays a video image.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A display apparatus comprising:

a timing controller, a data driver and a display panel;

wherein the timing controller receives input image data at a first frequency, the first frequency being substantially equal to a frame rate of an input image, and generates a data signal having the first frequency based on the input image data having the first frequency;

the data driver converts the data signal into a data voltage; and the display panel displays an image based on the data voltage, further comprising:

a decoder, a memory and a graphic processing unit;

wherein the decoder decodes the input image;

the memory stores the decoded input image in the memory; and the graphic processing unit converts the decoded input image into the input image data having the first frequency and outputs the input image data to the timing controller.

2. The display apparatus of claim 1, wherein the input image data includes active periods and blank periods which alternate with each other.

3. The display apparatus of claim 2, wherein each gap between the active periods are substantially uniform.

4. The display apparatus of claim 3, wherein a length of the active period is 1/60 second, and a length of the blank period is determined as the each gap of the adjacent active periods.

5. The display apparatus of claim 2, wherein when the first frequency is 30 Hz (hertz), a length of the active period is substantially equal to a length of the blank period.

6. The display apparatus of claim 2, wherein when the first frequency is less than 30 Hz (hertz), a length of the active period is less than a length of the blank period.

7. The display apparatus of claim 2, wherein the timing controller comprises a blank power control part, the blank power control part controls the data driver to be turned off during the blank period.

8. The display apparatus of claim 7, wherein the timing controller further comprises a register which stores the frame rate of the input image, and the blank power control part which outputs a blank control signal which varies according to the frame rate of the input image.

9. The display apparatus of claim 7, wherein the data driver comprises:

a power control part, a digital to analog converting part, a buffering part, a first switching part, and a second switching part;

wherein the power control controls a power according to a blank control signal determined according to the input image;

the digital to analog converting part converts the data signal from a digital signal to an analog signal;

the buffering part buffers the data voltage;

the first switching part turns on during the active periods and applies the data voltage to a data line; and the second switching part turns on during the blank periods and applies a blank voltage to the data line.

10. The display apparatus of claim 9, wherein the data driver further comprises a power switching part, the power switching part turns off the digital to analog converting part and the buffering part during the blank periods.

11. The display apparatus of claim 9, wherein the data driver further comprises a blank voltage providing part, the blank voltage providing part provides the blank voltage to the second switching part.

12. The display apparatus of claim 9, wherein the second switching part comprises:

switches in a first row and switches in a second row;

wherein the switches in the first row turn on alternately, and apply a first blank voltage to the data line; and the switches in a second row turn on alternately, and apply a second blank voltage to the data line.

13. A method of driving a display panel, the method comprising:

receiving input image data at a first frequency substantially equal to a frame rate of an input image;

generating a data signal having the first frequency based on the input image data having the first frequency; and displaying an image based on the data signal, further comprising:

decoding the input image;

storing the decoded input image in a memory;

converting the decoded input image into the input image data having the first frequency; and outputting the input image data to a timing controller.

14. The method of claim 13, wherein the input image data includes active periods and blank periods which alternate with each other.

15. The method of claim 14, wherein each gap between the active periods are substantially uniform.

16. The method of claim 14, wherein the timing controller controls a data driver to turn off during the blank periods.

17. The method of claim 14, wherein the timing controller further comprises a register which stores the frame rate of the input image.

* * * * *